United States Patent [19]

Omilusik

[11] Patent Number: 4,660,299

[45] Date of Patent: Apr. 28, 1987

[54] SPRING BOOT

[76] Inventor: Dale Omilusik, 4935 21 Ave., N.W., Calgary, Alberta, Canada, T3B 0X1

[21] Appl. No.: 817,992

[22] Filed: Jan. 13, 1986

[51] Int. Cl.[4] ..... A43B 13/18; A43B 21/30

[52] U.S. Cl. ..... 36/7.8; 36/28; 36/38; 36/27; 272/114

[58] Field of Search ..... 36/7.8, 37, 38, 27, 36/28, 29, 39, 102, 103, 105; 272/114

[56] References Cited

U.S. PATENT DOCUMENTS

| | | | |
|---|---|---|---|
| 337,146 | 3/1886 | Gluecksman | 36/7.8 |
| 822,448 | 6/1906 | Hanson | 36/7.8 |
| 1,566,513 | 12/1925 | Thackery | 36/7.8 |
| 1,670,747 | 5/1928 | Sestito | 36/38 |
| 2,475,092 | 7/1949 | Harrell | 36/7.8 |
| 2,710,460 | 6/1955 | Stasinos | 36/7.8 |
| 2,968,105 | 1/1961 | Rizzo | 36/2.5 |
| 3,875,688 | 4/1975 | McNaughton | 36/7.8 |
| 3,996,677 | 12/1976 | Reina | 36/7.8 |
| 4,258,483 | 3/1981 | Hogue | 36/7.5 |
| 4,296,557 | 10/1981 | Pajevic | 36/7.8 |
| 4,457,084 | 7/1984 | Horibata et al. | 36/7.8 |

FOREIGN PATENT DOCUMENTS

| | | | |
|---|---|---|---|
| 1485654 | 3/1970 | Fed. Rep. of Germany | 36/28 |
| 1024158 | 5/1953 | France | 36/28 |
| 980145 | 1/1965 | United Kingdom | 272/114 |

*Primary Examiner*—Werner H. Schroeder
*Assistant Examiner*—Steven N. Meyers
*Attorney, Agent, or Firm*—Norman B. Rainer

[57] ABSTRACT

A boot-type of footwear device is equipped with springs which enable the user to experience a bouncing effect. Four coil springs disposed in a rectangular pattern are disposed upon the underside of the boot. The upper extremities of the springs are embedded in an anchoring base such as a monolithic plastic casting affixed to the underside of the boot. The lowermost extremities of the springs have a non-slip footing. By virtue of its specialized construction, the device provides a more controlled effect during use.

1 Claim, 3 Drawing Figures

SPRING BOOT

BACKGROUND OF THE INVENTION

This invention relates to modified boots and more particularly to boots equipped with springs and adapted to provide novel effects in walking, jumping and running.

Shoes equipped with springs have been known heretofore. Such shoes have generally been equipped with coil springs removably attached to the underside of the shoe soles. The sought effect of the springs has generally been to provide a novel bouncing effect of interest for exercise and recreational pursuits. However, widespread use of such spring shoes has been thwarted by the unstable and unreliable characteristics of the bouncing effect and consequent accident possibilities. In those instances where special efforts were taken to ensure stability of the bouncing effect and safer use, there has been a loss in the maneuverability of the springs, particularly with respect to lateral thrusting movement. Such loss of maneuverability diminishes the versatility and recreational challenge of spring shoe devices.

It is accordingly an object of the present invention to provide spring-equipped footwear having a stable bouncing effect.

It is another object of this invention to provide footwear as in the foregoing object having improved internal thrusting movement.

It is a further object of the present invention to provide footwear of the aforesaid nature having improved safety in use.

It is still another object of this invention to provide footwear of the aforesaid nature of simple and rugged construction which may be economically manufactured.

These objects and other objects and advantages of the invention will be apparent form the following description.

SUMMARY OF THE INVENTION

The above and other beneficial objects and advantages are accomplished in accordance with the present invention by a footwear device comprising:

(a) a boot having a resilient upper member rising above ankle height, a forward portion, rear portion, lower periphery elongated along an axis extending between said forward and rear portions, and means for securing said upper member upon the foot of the user.

(b) a rigid monolithic anchoring base attached to said lower periphery, and (c) a spring assembly comprising four identical coil springs having upper and lower extremities, said lower extremities being provided with non-skid footings in coplanar disposition, said upper extremities being embedded within said anchoring base, said springs being vertically positioned beneath said anchoring base as a forward pair and rear pair disposed in a substantially rectangular pattern with each pair centered upon a line perpendicularly oriented to said axis.

In preferred embodiments of the invention, the anchoring base is a plastic casting, and the non-skid footing is preferably an elastic material into which the lower extremity of the spring is embedded. The elastic material may be a stiff rubber such as a polybutadiene or polyurethane molded in place upon the lowermost coils of the spring. The rigid plastic casting may be comprised of an acrylic composition applied by way of well known catalyzed fluid prepolymer formulations. Boots useful in the device of this invention are of the type generally used for hockey style ice skates. The coil springs are preferably of the type utilized as valve springs in internal combustion engines, and have a deformational pressure adjusted to the weight of the user. The springs are further selected so as to undergo compressional deformation of less than about 15% during normal use. The distance between the bottom of the boot and the bottom plane of the footings is preferably in the range of 2 to 5 inches.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
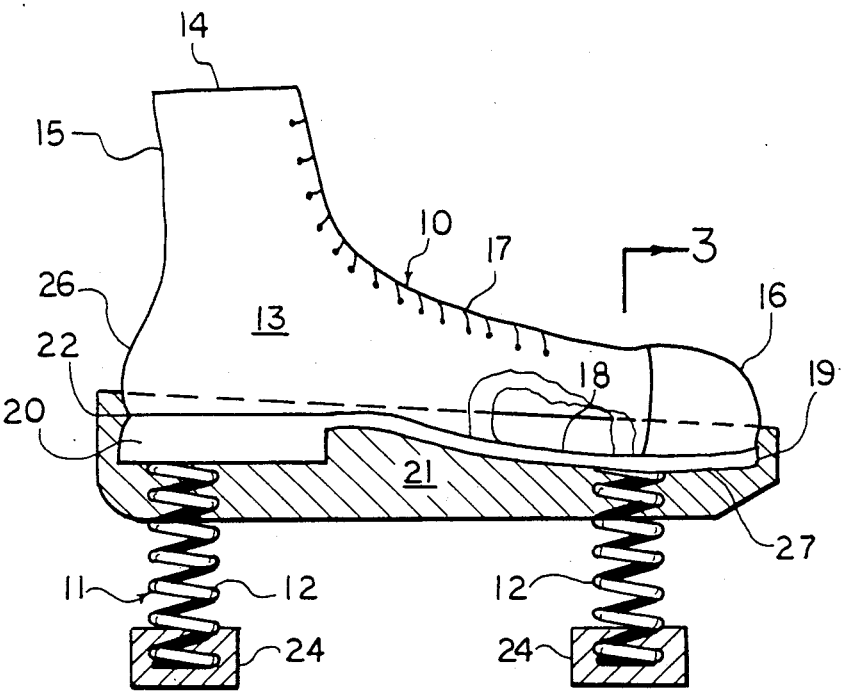
FIG. 1 is a fragmentary sectional side view of an embodiment of the footwear device of the present invention.

Referring to the drawing, an embodiment of the footwear device of this invention is shown comprised of a boot 10 having a spring assembly 11 comprised of four coil springs 12 disposed in a rectangular pattern.

The boot is comprised of upper member 13 fabricated of sturdy resilient sheet material such as leather or plastic and extending to an upper extremity 14 is located above the wearer's ankle. The upper member is further comprised of a rear portion 26, a forward portion which terminates in reinforced toe 16, lacing means 17 adapted to secure the boot upon the user's foot, and lower periphery 27 elongated along axis 23 extending between said rear and forward portions.

The resilient material of the upper member is attached by sewing, glueing or riveting to a substantially rigid sole 18 in a manner to form an outwardly protruding shoulder 19 circumscribing the forward portion of the upper member. A heel 20 is positioned below the rear portion of said upper member, the lower face of said heel being substantially coplanar with the lowermost portion of the lower face of the sole, the upper extremity of the heel forming a V-shaped trough 22 with respect to the upper member.

Figure 2:
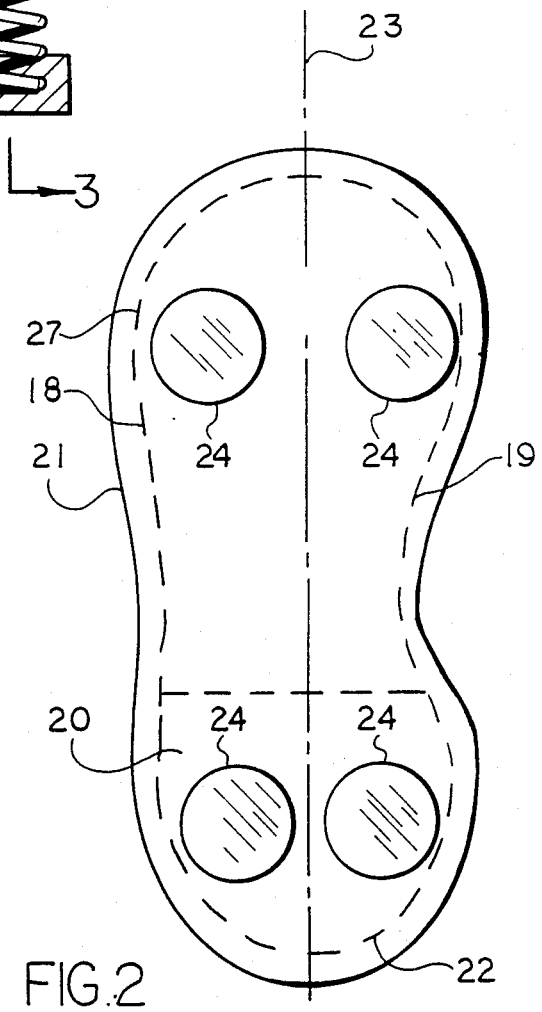
FIG. 2 is a bottom plan view of the device of FIG. 1.
Figure 3:
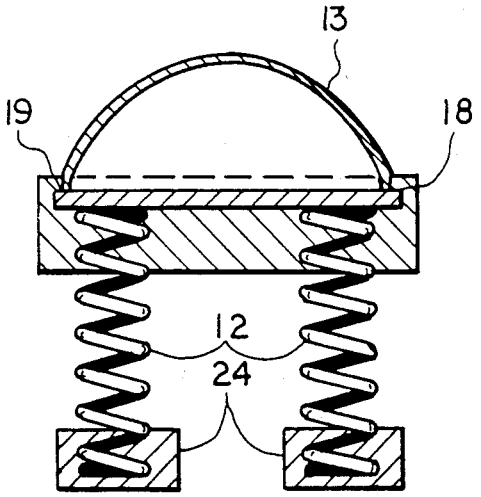
FIG. 3 is a sectional view taken on the line 3—3 of FIG. 1.

Each coil spring 12 is vertically aligned with respect to the underside of the boot. The upper one or two coils of the springs are embedded in a rigid monolithic plastic casting 21 which engulfs the heel, sole, protruding shoulder and trough above the heel. As shown in FIG. 2, the casting follows the general contour of the sole. However, in alternative embodiments, the casting may have a periphery characterized in having straight sides parallel to the axis of the boot. The casting may be formed from polymerizable materials capable of existing in a liquid precursor form, and hardenable in situ by catalyzing means. Acrylic resins are particularly useful in producing the casting. The casting is a rigid anchoring base for the springs, and may be downwardly tapered adjacent the heel and toe to provide greater clearance from the ground during compressive movements of the springs.

The springs are positioned such that one pair is beneath the rear portion and one pair beneath the forward portion of the boot. The springs are disposed in a substantially rectangular pattern with each pair centered on a line perpendicular to axis 23.

The lower extremity of each spring is provided with a non-skid footing 24 whose lower faces lie in coplanar disposition. The footings are preferably comprised of a stiff elastic polymer which can be cast from a liquid precursor to engulf the lowermost two coils of the spring. The perimeter of the footing may follow the circular cross-sectional configuration of the spring, or may have oval, square or other contours.

By virtue of the arrangement of the springs and their interaction with the boot, the device is capable of providing controllable forceful motion in lateral, axial and vertical directions. Because of such features, the device is useful in standing, walking, running and skating-like striding motion. The device finds use in certain working environments, in recreational and amusement pursuits, and in competitive games.

Although the anchoring base or plastic casting has been shown attached to the boot by way of engulfing the shoulder of the sole and the heel trough during a casting operation, other means may be employed for attaching the boot to an underlying anchoring base. For example, the anchoring base may also serve as the heel and sole, and the resilient upper member of the boot may be directly attached to the anchoring base by adhesives, mechanical fasteners, or a cast-in-place technique. However, when the anchoring base serves as a sole, a steel reinforcing shank is preferably positioned within the base centered upon axis 23.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A footwear device comprising:

(a) a boot having a resilient upper member rising above ankle height, a forward portion, rear portion, lower periphery elongated along an axis exending between said forward and rear portions, a sole associated with said lower periphery and forming a shoulder which protrudes outwardly from the boot, a heel associated with said lower periphery, and lacing means for securing said upper member upon the foot of the user, (b) a rigid monolithic anchoring base comprised of a plastic casting attached to said boot by way of engulfment of said shoulder and heel, and (c) a spring assembly comprising four identical coil springs having upper and lower extremities, at least two of the uppermost coils of said upper extremities being embedded within said plastic casting, said lower extremities being provided with non-skid footings having lower faces that lie in coplanar disposition, said springs being vertically positioned beneath said anchoring base as a forward pair and rear pair disposed in a substantially rectangular pattern with each pair centered upon a line perpendicularly oriented to the boot axis, said springs having a compressional deformation of less than about 15% during normal use and having a length between about 2 and 5 inches.

* * * * *